US006953373B1

(12) United States Patent
Vos

(10) Patent No.: US 6,953,373 B1
(45) Date of Patent: Oct. 11, 2005

(54) WIRE CONNECTOR

(75) Inventor: Michael Llewellyn Vos, Fish Hoek (ZA)

(73) Assignee: Dovetail Trading 144 CC, Fish Hoek (ZA)

( * ) Notice: Subject to any disclaimer, the term of this patent is extended or adjusted under 35 U.S.C. 154(b) by 0 days.

(21) Appl. No.: 10/947,282

(22) Filed: Sep. 23, 2004

(51) Int. Cl.[7] ..... H01R 11/09
(52) U.S. Cl. ..... 439/784; 439/790; 439/805; 174/87
(58) Field of Search ..... 439/784, 790–792, 439/805; 174/87

(56) References Cited

U.S. PATENT DOCUMENTS 5,228,875 A 7/1993 Swensen, Sr.
5,585,601 A 12/1996 Adler
5,695,369 A * 12/1997 Swenson, Sr. ..... 439/784
5,899,777 A 5/1999 Liang
6,220,902 B1 4/2001 Ivandic et al.
2004/0067696 A1 4/2004 Vos

* cited by examiner

*Primary Examiner*—Truc Nguyen
(74) *Attorney, Agent, or Firm*—Swidler Berlin LLP

(57) ABSTRACT

A wire connector which comprises first and second components that can be screwed together. Each component has a passageway which enables a wire to be passed through it from an entrance end to an exit end. Each component has an internal cavity into which the respective passageway opens. Each cavity is formed with wire entraining devices which drag around with them the free end portions of wires that have been passed through the passageways and cavities of one component and inserted into the cavities of the other component.

9 Claims, 3 Drawing Sheets

WIRE CONNECTOR

FIELD OF THE INVENTION

THIS INVENTION relates to wire connectors.

BACKGROUND TO THE INVENTION

It is common practice to connect two bare wires to one another by simply twisting the wires together. This provides an efficient connection as there is a large contact area between the wires.

Once twisted together the wires have to be taped for insulating purposes and to prevent them from untwisting.

Applicant is aware of U.S. Pat. No. 5,228,875 and 5,585,601 which disclose wire connectors in which two components of electrically insulating material are moved, e.g. rotated, with respect to one another so that wires are electrically connected. In U.S. Pat. No. 5,585,601 the wires are twisted together whereas in U.S. Pat. No. 5,228,875 one wire is compressed into engagement with an electrical contact. The connectors conceal the bared wires so that taping is not necessary. The connector components, once firmly secured together, prevent the wires from untwisting or coming out of electrical contact with one another.

The present invention seeks to provide an improved wire connector which enables two bare wires to be connected together rapidly by the simple expedient by screwing together two connector components through each of which a wire passes.

BRIEF DESCRIPTION OF THE INVENTION

According to one aspect of the present invention there is provided a connector for joining two bare electrical wires, the connector comprising a first component having external threading and a second component having internal threading compatible with the threading of the first component whereby said components can be screwed together and unscrewed from one another by relative rotation of said components about an axis, a first passageway through said first component, said first passageway leading from an entrance into a first internal space bounded by said first component, said first space being open on the side thereof remote from said first passageway, a second passageway through said second component, said second passageway leading from an entrance into a second internal space bounded by said first component, said second space being open on the side thereof remote from said second passageway, a first array of wire entraining means in said first space for entraining a wire which has passed through said second passageway and said second space and entered said first space through said open side thereof, and a second array of wire entraining means in said second space for entraining a wire which has passed through said first passageway and said first space and entered said second space through said open side thereof.

Preferably said first and second arrays of wire entraining means each comprises partitions extending across said spaces and sub-dividing them into a plurality of sub-spaces. In one specific embodiment each array comprises a pair of partitions which are at right angles to one another, the pairs of partitions dividing each of said spaces into quadrants. In an alternative embodiment each array comprises a plurality of pins which extend towards said open sides of the spaces, there being wire receiving gaps between the pins.

In another form said arrays can each comprise a circumferentially extending groove, each groove having wider sections and narrower sections, the narrower sections serving to trap the tips of wires entered into said grooves.

The passageways can each be offset from said axis. In one embodiment the distance from one of said passageways to the axis is different from the distance from the other passageway to the axis. Alternatively said passageways can be co-axial with said axis and have surfaces which are skew to said axis for guiding the leading ends of wires being inserted into said passageways to positions offset with respect to said axis.

To facilitate use, each of said components can comprise a wire guiding inlet of tapering form, each inlet having a wide wire receiving end and a narrow wire outlet end, said entrances of the respective passageways being at said narrow wire outlet ends of said inlets.

BRIEF DESCRIPTION OF THE DRAWINGS

For a better understanding of the present invention, and to show how the same may be carried into effect, reference will now be made, by way of example, to the accompanying drawings in which:—

DETAILED DESCRIPTION OF THE DRAWINGS

Figure 1:
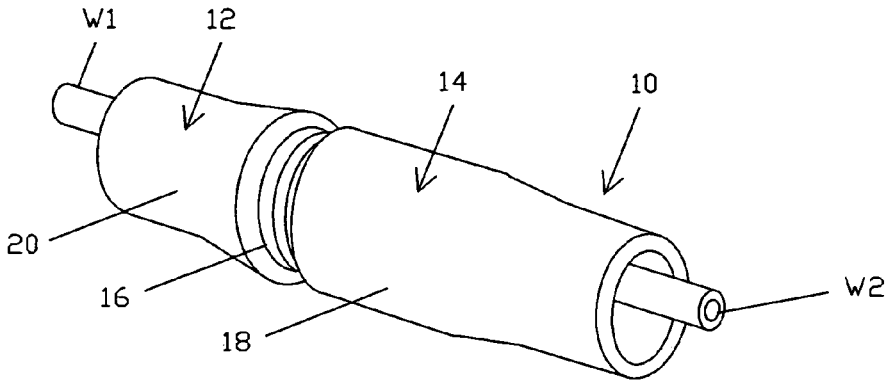
FIG. 1 is a pictorial view of an electrical wire connector shown with its two components screwed together.

The wire connector 10 illustrated in FIG. 1 comprises two components which are designated 12 and 14. The component 12 has a cylindrical externally threaded section 16 and the component 14 has a cylindrical section 18 which is provided with internal threading compatible with that of the section 16.

Figure 6:
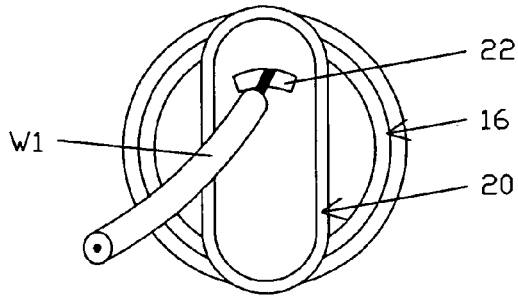

The component 12 has a further section, designated 20, from which the section 16 protrudes. The section 20 is, as best seen in FIG. 6, of generally oval shape. Internally the section 20 tapers from its wide open end (the left hand end in FIG. 1) to the entrance to a bore 22 which is offset from the axis of the section 16. The internal taper of the section 20 guides a wire inserted from the open end of the section 20 to the entrance to the bore 22.

The bore 22 is not of circular cross section but is of a slightly greater dimension measured in the circumferential direction than in the radial direction. This is also best seen in FIG. 6.

Figure 5:
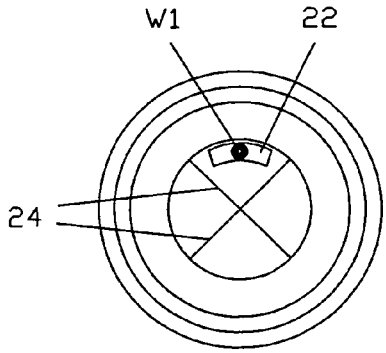
FIGS. 5 and 6 are end views of one of the components of the connector of FIGS. 1, 3 and 4.

Within the section 16 there are two transverse partitions 24 (FIG. 5) which are a right angles to one another and which consequently divide the interior space of the section 16 into four quadrants. The bore 22 opens into one of the quadrants.

Figure 7:
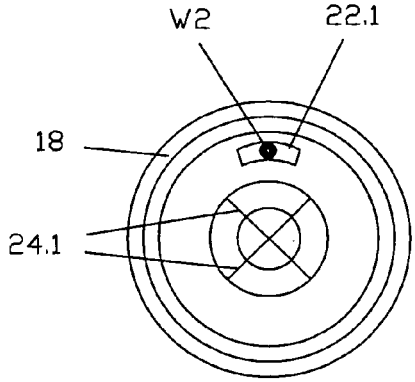
FIGS. 7 and 8 are end views of the other component of the connector of FIGS. 1, 3 and 4.
Figure 8:
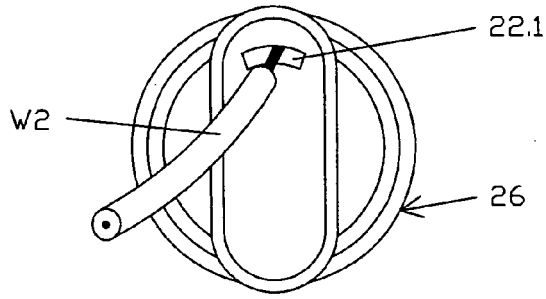

The configuration of the component 14 (FIGS. 7 and 8) is substantially the same as that of the component 12. However, because the section 18 has to receive the section 16, the partitions of the component 14, designated 24.1, cannot be inside the section 18. Consequently the component 14 is provided with an intermediate section 26 which is between the section 18 and a section 28 which tapers internally and has in it the bore 22.1. The partitions 24.1 are within the section 26. The bore 22.1 is further from the axis of the connector than the bore 22.

Figure 2:
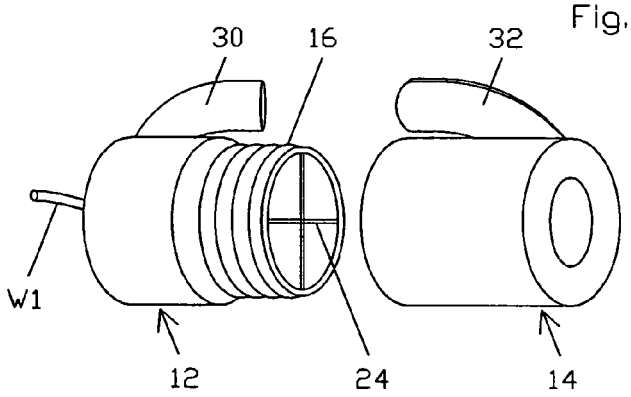
FIG. 2 illustrates a wire connector of somewhat different shape with the two component parts unscrewed and separated.

Protrusions 30, 32 (FIG. 2) can be provided for facilitating rotation of the components of the connector relative to one another. The connector of FIG. 2 is shorter than the connector of FIGS. 1, 3 and 4 but is configured, internally, in the same way as the connector of FIGS. 1, 3 and 4.

Figure 3:
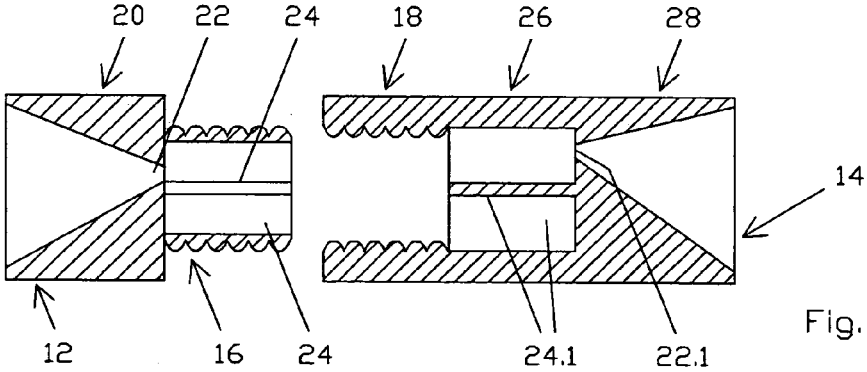
FIG. 3 is a section through the wire connector of FIG. 1 with its two components adjacent one another but not screwed together.
Figure 4:
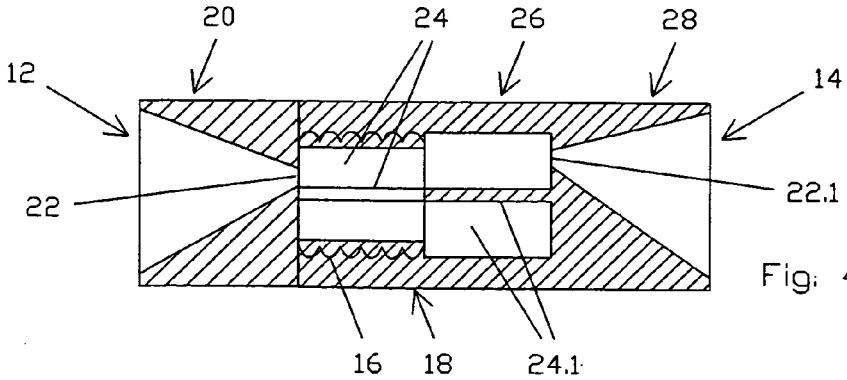
FIG. 4 shows the two components of FIG. 3 fully screwed together.

The connector of FIGS. 1, 3 and 4 is used by placing the two components end-to-end (see FIG. 3) and engaging their threads by a fraction of a turn. The bare wires W1 and W2 are then inserted into the bores 22, 22.1. The tapering internal configurations of the sections 20, 28 guides the tips of the wires W1, W2 to the entrances to the bores 22, 22.1.

The wire W1 passes through the bore 22 of the component 12 and its leading ends enters that quadrant of the section 16 to which the bore 22 leads. The wire W1 is fed in until it passes through that quadrant and into one of the quadrants of the component 14. Similarly the wire W2 is inserted through the bore 22.1 of the component 14 and fed in until its leading end is within one of the quadrants of the component 12. The partitions 24, 24.1 act to capture the ends of the wires W1, W2.

When the two components are turned relatively to one another towards the position shown in FIG. 4, the partitions 24, 24.1 entrain the ends of the wires W1 and W2 and pull them around so that the free end portions of the wires W1, W2 move in a circular motion about the common axis of the two components. The parts of the wires W1, W2 which, as best shown in FIG. 3, were in the gap between the sets of partitions 24, 24.1, are twisted together.

Figure 9:
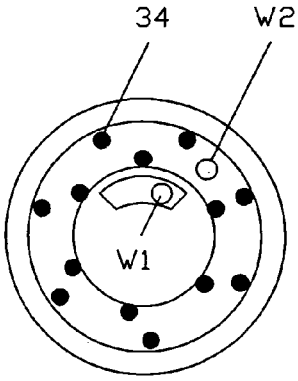
FIGS. 9 to 11 illustrate wire capturing constructions.

FIG. 9 shows a component 12 in which the partitions 24 are replaced by a series of protruding pins 34 the spacing between which is such that the bared wire W2 cannot pass through the gaps between the pins when the components are rotated. Thus the pins act to entrain the wire ends so that the wires are twisted together. The sets of pins on the components 12 and 14 are on different diameters to accommodate the positions of the bore 22, 22.1 through which the wires W1, W2 pass.

Figure 10:
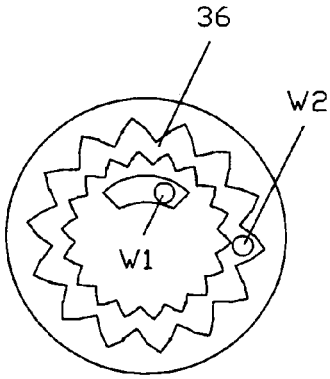

In FIG. 10, the pins 34 are replaced by a circumferentially extending groove 36 which has wider sections and narrower sections. The width of the narrower sections is less than the thickness of the wire. Thus during rotation the tip of the wire is picked up by one of the narrower sections and carried around.

Each component 12 and 14 has a groove 36, the grooves being of different diameters to accommodate the difference in the positions of the bores 22, 22.1. Thus the groove of the component 14 is inwardly of the groove 36 illustrated so that the wire W1 enters this groove.

Figure 11:
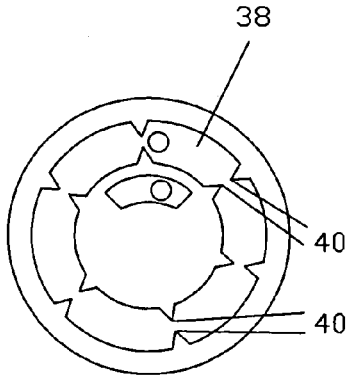

The construction of FIG. 11 is similar to that of FIG. 10 except in that the groove 38 is of constant width, measured radially, and has a series of pairs of teeth 40 which define the narrower sections.

Figure 12:
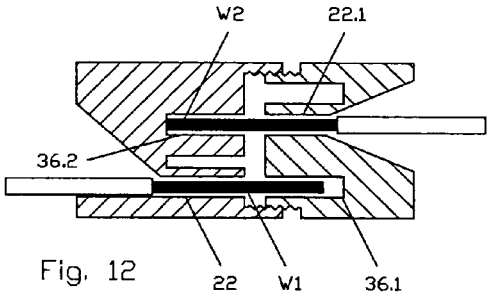
FIGS. 12 and 13 are sections showing a further form of connector before the components are screwed together and after they are screwed together.
Figure 13:
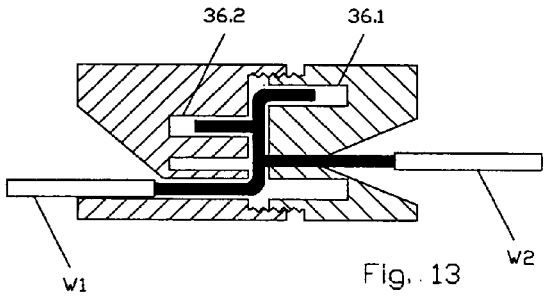

In FIGS. 12 and 13 the separated and joined states of a connector having wire capturing elements of the form illustrated in FIGS. 10 and 11 is shown. In this form the bore 22 is radially outwardly of the bore 22.1. The tip of wire W1 is in the larger diameter groove 36.1 of the component 14 and the tip of the wire W2 is in the smaller diameter groove 36.2 of the component 12. It will be noted from FIG. 13 that the tips of the wires pull back from the bottoms of the grooves 34.1, 34.2 when the wires are twisted.

Figure 14:
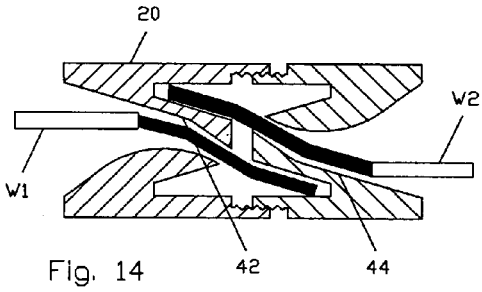
FIG. 14 is a section through a further connector with the components presented to one another but not screwed together.
Figure 15:
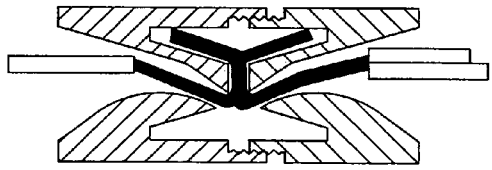
FIG. 15 is a section illustrating the connector of FIG. 14 with the components screwed together.

In the embodiments thus far described, tip-to-tip contact between the wires W1, W2 is prevented by placing the bores 22, 22.1 at different radial distances from the axis. In FIGS. 14 and 15 surfaces 42, 44 are provided on the components 12, 14 for directing the tips of the wires W1, W2 radially outwardly into the appropriate grooves. FIG. 14 shows the wires W1, W2 before twisting and FIG. 15 shows the wires after twisting.

What is claimed is:

1. A connector for joining two bare electrical wires, the connector comprising a first component having external threading and a second component having internal threading compatible with the threading of the first component whereby said components can be screwed together and unscrewed from one another by relative rotation of said components about an axis, a first passageway through said first component, said first passageway leading from an entrance into a first internal space bounded by said first component, said first space being open on the side thereof remote from said first passageway, a second passageway through said second component, said second passageway leading from an entrance into a second internal space bounded by said second component, said second space being open on the side thereof remote from said second passageway, a first array of wire entraining means in said first space for entraining a wire which has passed through said second passageway and said decond space and entered said first space through said open side thereof, and a second array of wire entraining means in said second space for entraining a wire which has passed through said first passageway and said first space and entered said second space through said open side thereof.

2. A connector as claimed in claim 1, wherein said first and second arrays of wire entraining means each comprises partitions extending across said spaces and sub-dividing them into a plurality of sub-spaces.

3. A connector as claimed in claim 2, wherein each array comprises a pair of partitions which are at right angles to one another, the pairs of partitions dividing each of said spaces into quadrants.

4. A connector as claimed in claim 1, wherein each of said arrays comprises a plurality of pins which extend towards said open sides of the spaces, there being wire receiving gaps between the pins.

5. A connector as claimed in claim 1, wherein each of said arrays comprises a circumferentially extending groove, the grooves having wider sections and narrower sections, the narrower sections serving to trap the tips of wires entered into said grooves.

6. A connector as claimed in claim 1, wherein said passageways are each offset from said axis.

7. A connector as claimed in claim 6, wherein the distance from one of said passageways to the axis is different from the distance from the other passageway to the axis.

8. A connector as claimed in claim 1, wherein said components have surfaces which are skew to said axis for guiding the leading ends of wires being inserted into said passageways to positions offset with respect to said axis.

9. A connector as claimed in claim 1, wherein each of said components comprises a wire guiding inlet of tapering form, each inlet having a wide wire receiving end and a narrow wire outlet end, said entrances of the respective passageways being at said narrow wire outlet ends of said inlets.

* * * * *